US012127698B2

(12) United States Patent
Lopez

(10) Patent No.: US 12,127,698 B2
(45) Date of Patent: Oct. 29, 2024

(54) SOCK REMOVER

(71) Applicant: Vive Health LLC, Naples, FL (US)

(72) Inventor: Juan Lopez, Naples, FL (US)

(73) Assignee: Vive Health LLC, Naples, FL (US)

( * ) Notice: Subject to any disclaimer, the term of this patent is extended or adjusted under 35 U.S.C. 154(b) by 12 days.

(21) Appl. No.: 18/078,063

(22) Filed: Dec. 8, 2022

(65) Prior Publication Data

US 2024/0188742 A1 Jun. 13, 2024

(51) Int. Cl.
*A47G 25/90* (2006.01)

(52) U.S. Cl.
CPC ..... *A47G 25/908* (2013.01)

(58) Field of Classification Search
CPC ..... A47G 25/905; A47G 25/908
See application file for complete search history.

(56) References Cited

U.S. PATENT DOCUMENTS

| | | | | |
|---|---|---|---|---|
| 3,591,226 | A * | 7/1971 | Elmore, Jr. | A47G 25/82 223/119 |
| D259,299 | S | 5/1981 | Vreeken | |
| 5,687,889 | A * | 11/1997 | Liden | A47G 25/80 223/111 |
| 6,763,982 | B1 | 7/2004 | Livornese | |
| 8,109,418 | B1 | 2/2012 | Recchia et al. | |
| 9,386,875 | B2 | 7/2016 | Clifton | |
| 10,463,184 | B2 * | 11/2019 | Taylor | A47G 25/908 |
| 11,375,837 | B2 | 7/2022 | Fleming | |
| 2015/0190006 | A1 | 7/2015 | Fowler | |
| 2018/0220825 | A1 | 8/2018 | Havivy | |

FOREIGN PATENT DOCUMENTS

| | | |
|---|---|---|
| DE | 4228916 | 3/1994 |
| DE | 29708855 | 10/1997 |
| DE | 202008015999 | 2/2009 |
| EP | 1791453 | 6/2007 |
| EP | 2653076 | 10/2013 |
| WO | 2003059131 | 7/2003 |

OTHER PUBLICATIONS

RMS—Sock Aid Kit, Web, <https://www.myrmsstore.com/products/sock-on-sock-off-kit>, retrieved Nov. 29, 2022.
Sock & Shoe Assist Kit, Web, <https://www.vivehealth.com/products/sock-aid-kit>, retrieved Nov. 29, 2022.
Sock Ox Sock Aid World's Fastest Sock Tool, Web, <https://www.easycomforts.com/buy-sock-ox-sock-aid-world-s-fastest-sock-tool-372211?sourcecode=30501000122&gclid=Cj0KCQjwmdGYBhDRARIsABmSEeNfAxSb5Uj-hLpC_wM7SBdOV1UAV0qT8zcVqGwqm3aWJqXYMrK9GVcaAkpSEALw_wcB>, retrieved Nov. 29, 2022.
Shoe Horn and Sock Remover, Web, <https://www.thewrightstuff.com/shoe-horn-and-sock-remover.html>, retrieved Nov. 29, 2022.

* cited by examiner

*Primary Examiner* — F Griffin Hall

(57) ABSTRACT

The present invention relates to a device for removing clothing. Specifically, the device may be used to remove a sock from a user's foot. The device may have a handle end, a removing end, and a shaft. A removing head may be configured at the removing end. A first flange may extend from the shaft away from the handle end. A second flange and third flange may be configured on the removing head. The second shaft may extend away from the handle end, and the third flange may extend towards the handle end. The third flange may be configured to catch the user's pant leg to lift the pant leg towards the user's knee. The first and second flanges may be configured to catch the user's sock to remove the sock from the user's foot.

13 Claims, 5 Drawing Sheets

SOCK REMOVER

BACKGROUND OF THE INVENTION

The present invention relates to a device for removing clothing, specifically for removing a sock from a user's foot. Mobility issues such as arthritis may hinder someone's ability to remove their clothing. Socks may be particularly difficult to remove for people with mobility issues since sock removal requires more bending of certain joints than is required to remove other articles of clothing. Sock removal may also require lifting of a pant leg if long pants are worn whereby the top of the sock is covered by the pant leg.

SUMMARY OF THE INVENTION

The present invention relates to a device for removing clothing. Specifically, the device may be used to remove a sock from a user's foot. The device may have a handle end and a removing end opposite the handle end. Since the handle end and removing end are opposite one another, "extending away from the removing end" can also be considered as "extending towards the handle end" and vice versa. A handle may be configured at the handle end. A removing head may be configured at the removing end. A shaft may be configured between the handle end and removing end. A first flange may extend from the shaft away from the handle end. A second flange and third flange may be configured on the removing head. The second shaft may extend away from the handle end, and the third flange may extend towards the handle end.

The shaft may have a shaft length. The shaft length may be 6 inches or more, 12 inches or more, 24 inches or more, 36 inches or more, or any range between and including the shaft length values provided. The shaft may be made of any material, including but not limited to a plastic, metal, wood, or composite. The shaft may be straight. Alternatively, the shaft may have a curvature. In embodiments wherein the shaft has a curvature, "parallel to the shaft" may be defined as parallel to a shaft axis extending from a first end of the shaft to a second end of the shaft. Likewise, "perpendicular to the shaft" may be defined as perpendicular to the shaft axis extending from the first end of the shaft to the second end of the shaft. Likewise, "configured at an angle relative to the shaft" may be defined as configured at an angle relative to the shaft axis extending from the first end of the shaft to the second end of the shaft.

The handle may be made of any material, including but not limited to a plastic, metal, wood, or composite. The handle may be coated in an elastomer such as silicone or rubber in order to provide a user with a better grip when the user grasps the handle. The handle may have a curvature. The handle may be permanently attached to the shaft. Alternatively, the handle may be removably attached to the shaft by a buckle. The buckle may be a common pronged buckle, wherein two prongs are inserted into two openings whereby the prongs expand within the openings to secure the buckle together. The prongs may then be pressed towards one another to detach the buckle. In embodiments wherein the buckle is a common pronged buckle, the prongs may be configured on the shaft, and the openings may be configured on the handle. Alternatively, the buckle may any other type of buckle known in the art of buckles. The buckle may also be a variation of the common pronged buckle, whereby the buckle may have one or more prongs and one or more openings.

The first flange may be made of any material, including but not limited to a plastic, metal, wood, or composite. The first flange may extend from the shaft away from the handle end. The first flange may extend a first flange length. The first flange length may be 2 inches or more, 4 inches or more, or any range between and including the first flange length values provided. The first flange may be configured at a first flange angle relative to the shaft. The first flange angle may be 0 degrees or more, 3 degrees or more, or any range between and including the first flange angle values provided. Since the first flange angle may be 0 degrees, the first flange may be configured parallel to the shaft.

The removing head may be connected to an offset member whereby the removing head is configured an offset distance from the shaft. The offset distance may be perpendicular to the shaft. The offset member itself need not be perpendicular to the shaft in order to configure the removing head a perpendicular offset distance from the shaft. The second flange and third flange of the removing head may be connected at a removing head center point. The offset member may contact the removing head at the removing head center point, whereby the second flange, third flange, and offset member are connected at the removing head center point. The second flange, third flange, and offset member may be connected at additional points, whereby the removing head center point is the middle point of the connection between the second flange, third flange, and offset member. The removing head and offset member may be made of any material, including but not limited to a plastic, metal, wood, or ceramic.

The second flange may extend from the removing head center point away from the handle end. The second flange may extend a second flange length. The second flange length may be 2 inches or more, 4 inches or more, or any range between and including the second flange length values provided. The second flange may be configured at a second flange angle relative to the shaft. The second flange angle may be 0 degrees or more, 3 degrees or more, or any range between and including the second flange angle values provided. Since the second flange angle may be 0 degrees, the second flange may be configured parallel to the shaft.

The third flange may extend from the removing head center point towards the handle end. The third flange may extend a third flange length. The third flange length may be 2 inches or more, 4 inches or more, or any range between and including the third flange length values provided. The third flange may be configured at a third flange angle relative to the shaft. The third flange angle may be 0 degrees or more, 3 degrees or more, or any range between and including the third flange angle values provided. Since the third flange angle may be 0 degrees, the third flange may be configured parallel to the shaft.

The second flange length and the third flange length may be equal. The first flange length may be smaller than the second flange length. The second flange angle and the third flange angle may be equal. The first flange angle may be equal to the second flange angle and the third flange angle.

The third flange may be configured to catch a bottom of a pant leg of a user to lift the pant leg towards the user's knee. The first flange and second flange may be configured to catch a top of a user's sock to remove the sock from the user's foot.

To use the device to remove a sock from the user's foot, the user may grasp the handle. The user may catch the bottom of their pant leg between the third flange and the shaft. The user may lift the device whereby the pant leg is lifted towards the user's knee, thereby exposing the top of the user's sock. The user's leg may also be exposed when the pant leg is lifted. The user may catch the top of their sock between the first flange and second flange. The user may push the device whereby the sock is moved down the user's foot whereby the sock is removed from the user's foot.

The user's pant leg does not need to be lifted in order to use the device to remove a sock form the user's foot. The pant leg may be lifted in situations wherein the user is wearing long pants whereby the pant leg covers the top of the sock. The pant leg is thus lifted in order to access the top of the sock so that the sock may be removed from the user's foot.

DETAILED DESCRIPTION

The description provided herein describes example embodiments of the present invention and is not intended to limit the invention to any particular embodiment, feature, component, shape, size, design, use, functionality, material, or any other property. Furthermore, the drawings provided herein show example embodiments of the present invention and are not intended to limit the invention to any particular embodiment, feature, component, shape, size, design, use, functionality, material, or any other property.

Figure 1:
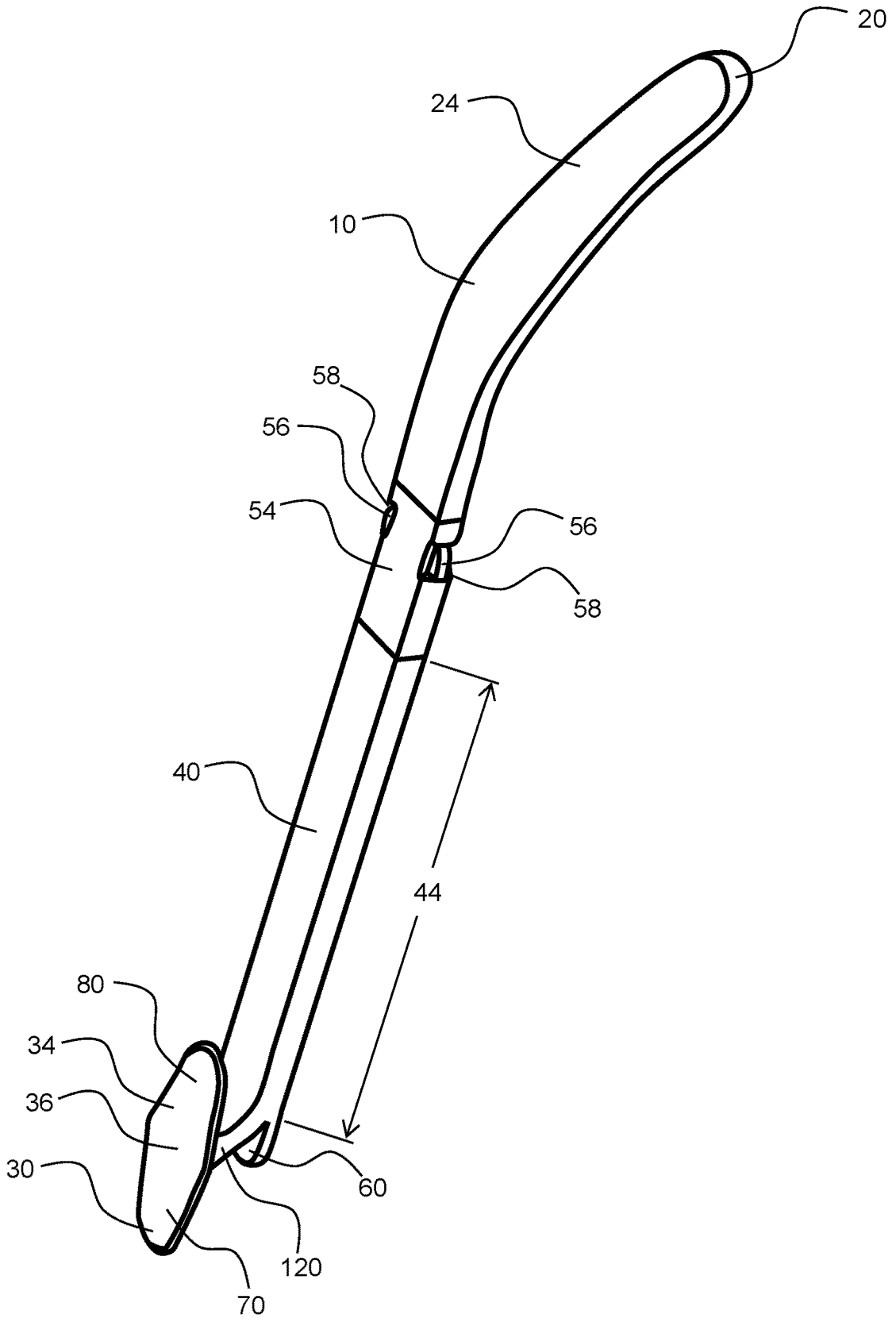
FIG. 1 is a bottom right-side perspective view of a device for removing clothing.

As shown in FIG. 1, a device for removing clothing 10 has a handle end 20 and a removing end 30. The removing end 30 and handle end 20 are configured opposite one another, whereby "extending away from the removing end" can also be considered as "extending towards the handle end" and vice versa. A handle 24 is configured at the handle end 20. A removing head 34 is configured at the removing end 30. A shaft 40 separates the handle 24 from the removing end 34. The shaft 40 has a shaft length 44 that extends from an offset member 120 to a buckle 54. The buckle 54 may serve to removably attach the handle 24 and the shaft 40. The buckle 54 shown in FIG. 1 is a common pronged buckle, wherein two prongs 56 are respectively inserted into two openings 58 whereby the prongs 56 expand within the openings 58 to prevent the buckle 54 from unintentionally disassociating. The prongs 56 may be configured on the shaft 40, and the openings 58 may be configured on the handle 24.

A first flange 60 extends from the shaft 40 towards the removing end 30. An offset member 120 extends from the shaft 40 at an angle to the first flange 60. The removing head 34 is configured on the offset member 120 whereby the removing head 34 is offset from the shaft 40. A second flange 70 and third flange 80 are configured on the removing head 34. The second flange 70 extends towards the removing end 30 and the third shaft 80 extends towards the handle end 20. The second flange 70, third flange 80, and offset member 120 are connected at a removing head center point 36.

Figure 2:
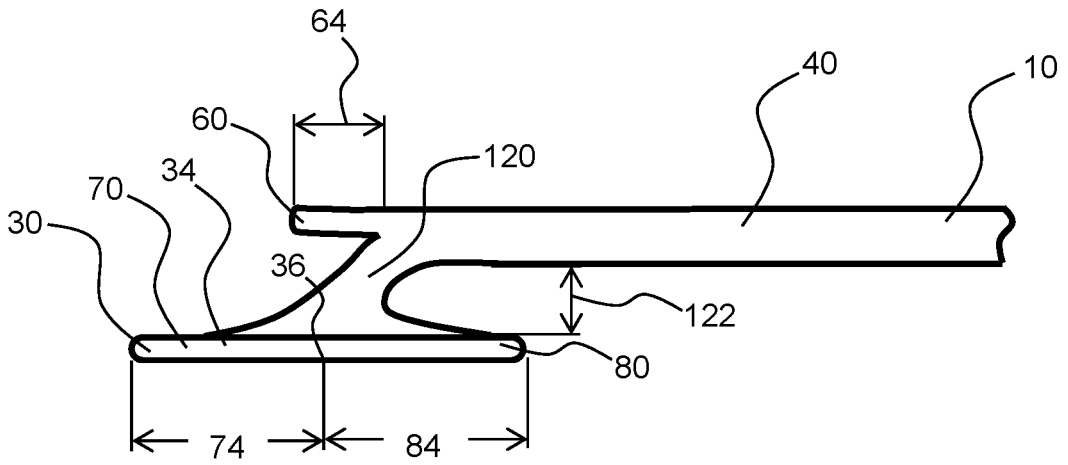
FIG. 2 is a partial left-side view of a device for removing clothing.

As shown in FIG. 2, the first flange 60 extends a first flange distance 64 from the shaft 40 towards the removing end 30. The first flange distance 64 begins at a point where the first flange 60, offset member 120, and shaft 40 meet. The offset member 120 causes the removing head 34 to be offset and offset distance 122 from the shaft 40. The offset distance 122 extends perpendicular to the shaft 40 even though the offset member 120 may extend in a direction that is not completely perpendicular to the shaft 40. The second flange 70 extends a second flange distance 74 from the removing head center point 36 towards the removing end 30. The third flange 80 extends a third flange distance 84 from the removing head center point 36 away from the removing end 30. As shown in FIG. 2, the first flange 60, second flange 70, and third flange 80 extend parallel to the shaft 40.

Figure 3:
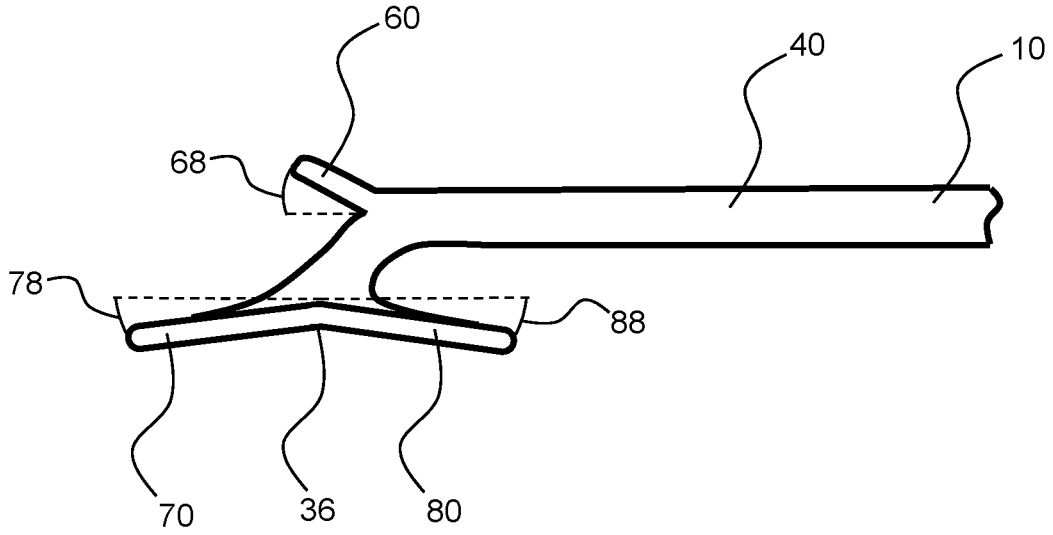
FIG. 3 is a partial left-side view of a device for removing clothing, showing a first flange angle, a second flange angle, and a third flange angle.

As shown in FIG. 3, the first flange 60 extends at a first flange angle 68 relative to the shaft 40, whereby the first flange 60 does not extend parallel to the shaft 40. The second flange 70 extends at a second flange angle 78 from the removing head center point 36 relative to the shaft, whereby the second flange 70 does not extend parallel to the shaft 40. The third flange 80 extends at a third flange angle 88 from the removing head center point 36 relative to the shaft, whereby the third flange 80 does not extend parallel to the shaft 40.

Figure 4:
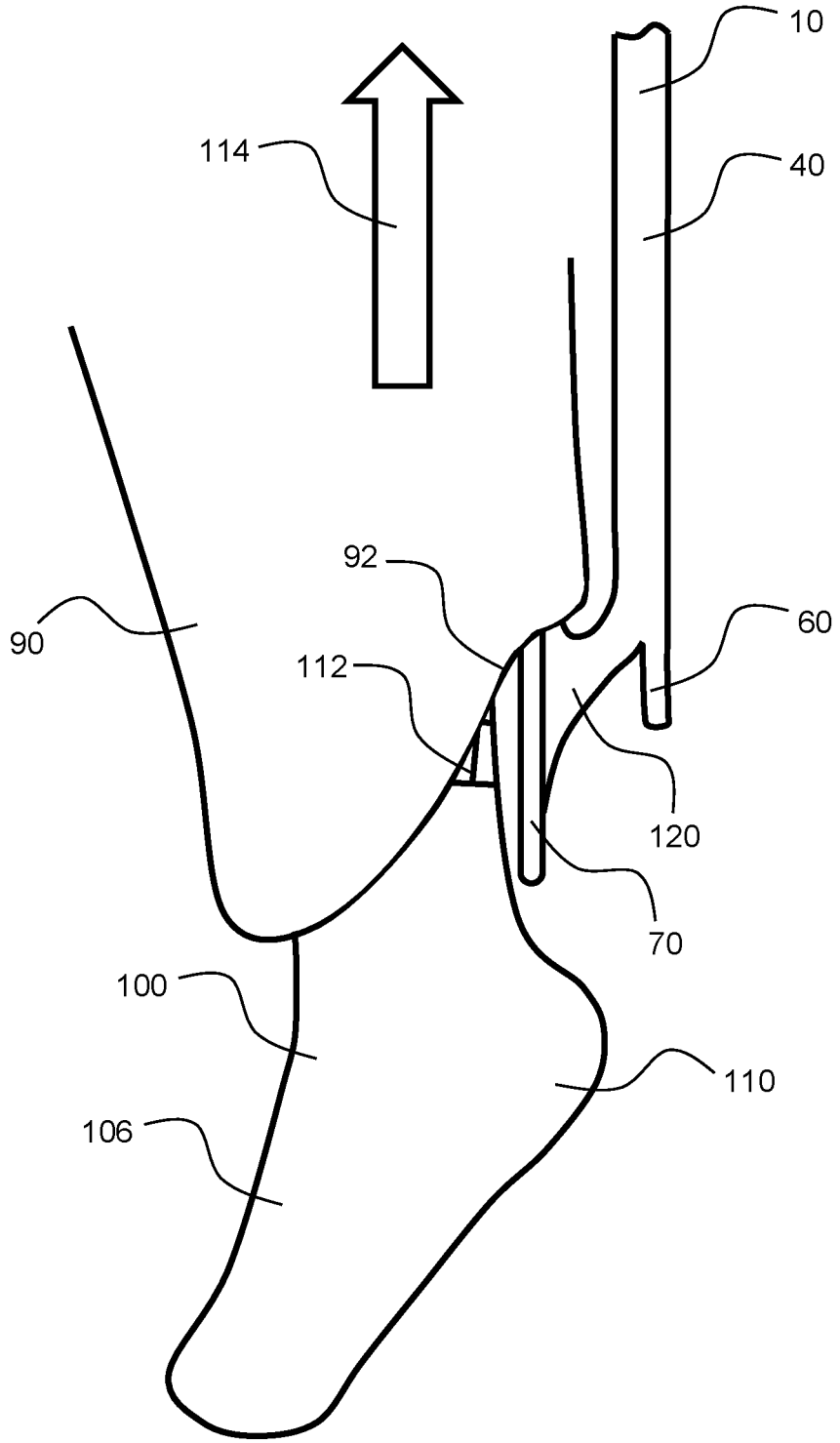
FIG. 4 is right-side view of a device for removing clothing lifting a pant leg of a user towards the user's knee.

As shown in FIG. 4, the device for removing clothing 10 may be used to lift a pant leg 90 of a user 100 in a direction towards the user's knee 114. The third flange (not visible in FIG. 4) is configured to catch a bottom 92 of the pant leg 90 in order to lift the pant leg 90 in the direction towards the user's knee 114. This exposes the top 112 of the user's sock 110. By catching the bottom 92 of the pant leg 90 with the third flange, the pant leg 90 may contact the offset member 120 between the third flange and the shaft 40. The pant leg 90 may also contact the third flange and the shaft 40.

Figure 5:
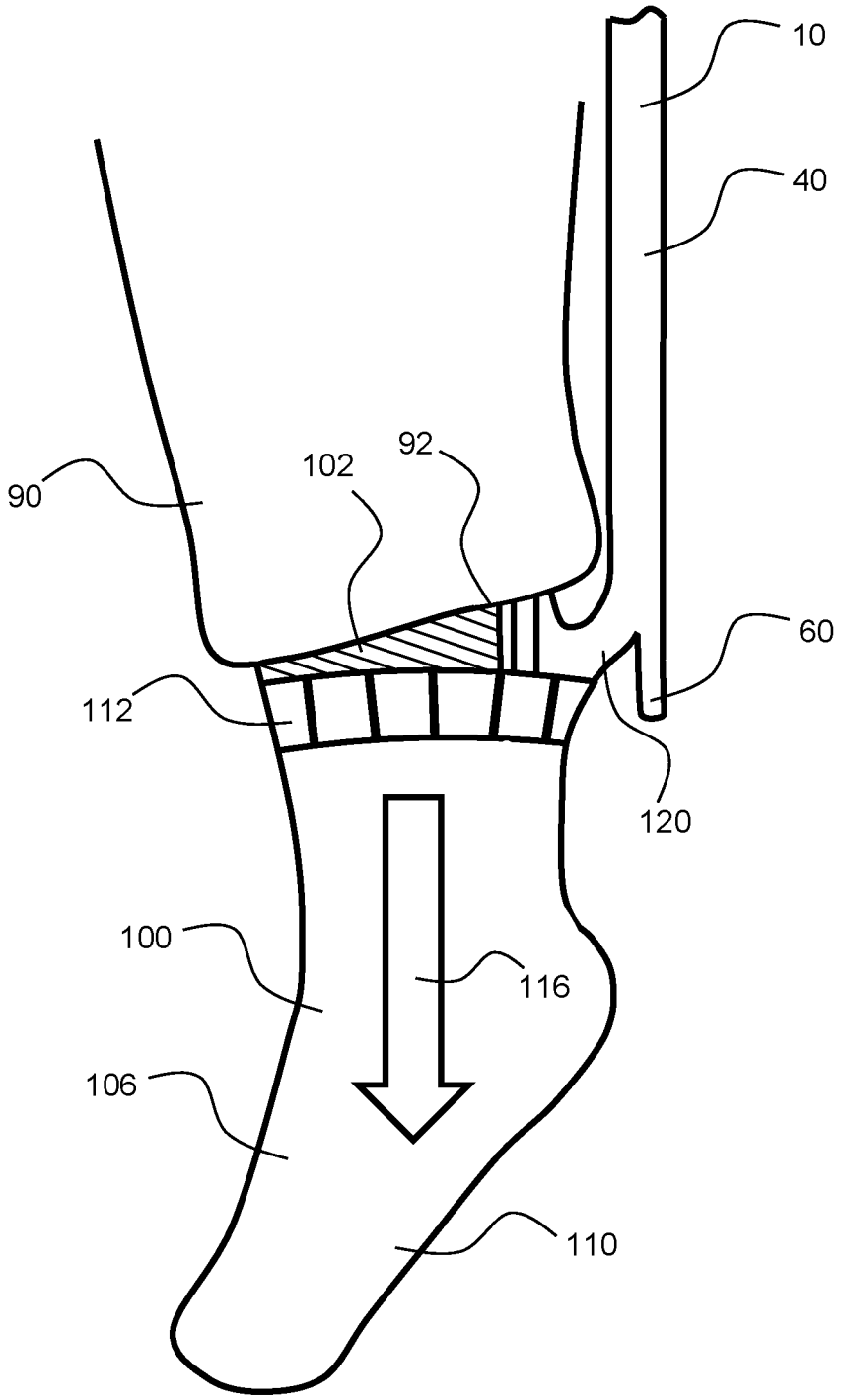
FIG. 5 is a right-side view of a device for removing clothing removing the sock of a user from the user's foot.

As shown in FIG. 5, a leg 102 of the user 100 is exposed since the pant leg 90 has been lifted using the device for removing clothing 10. The first flange 60 and second flange (not visible in FIG. 5) are configured to catch the top 112 of the user's sock 110 in order to remove the user's sock 110 from the user's foot 106. The device for removing clothing 10 may be used to push the sock 110 in a direction down the user's foot 116 in order to remove the sock 110 from the user's foot 106. By catching the top 112 of the sock 110 with the first flange 60 and second flange, the sock 110 may contact the offset member 120 between the first flange 60 and the second flange. The sock 110 may also contact the first flange 60 and the second flange.

What is claimed is:

1. A device for removing clothing, comprising:

a handle end;

a removing end;

a shaft configured between the handle end and the removing end, the shaft comprising a shaft length;

a handle configured at the handle end;

a first flange extending away from the handle end, the first flange comprising a first flange length;

a removing head configured at the removing end, the removing head comprising:

a second flange extending away from the handle end;

a third flange extending towards the handle end; and an offset member connecting the removing head to the shaft, whereby the removing head is configured an offset distance from the shaft, wherein the offset distance is perpendicular to the shaft, wherein the second flange and the third flange are both configured parallel to the shaft, wherein the first flange, the removing head, the offset member, and the shaft are one monolithic piece, wherein the first flange, the removing head, the offset member, and the shaft are configured in a fixed position relative to one another, wherein the removing head comprises a flange face, wherein the flange face faces away from the offset member, wherein the flange face is flat, wherein the offset distance is at least half the first flange length, wherein the third flange is configured to catch a bottom of a pant leg of a user to lift the pant leg towards the user's knee, and wherein the first flange and second flange are configured to catch a top of a sock of a user to remove the sock from the user's foot.

2. The device of claim 1, wherein the second flange, the third flange, and the offset member are connected at a removing head center point.

3. The device of claim 2, wherein the first flange is configured at a first flange angle relative to the shaft.

4. The device of claim 3, wherein the first flange angle is 0 degrees or more.

5. The device of claim 3, wherein the first flange angle is 3 degrees or more.

6. The device of claim 1, wherein the first flange extends from the shaft.

7. The device of claim 1, wherein the handle is removably attached to the shaft by a buckle comprising:

two prongs; and two openings, wherein the two prongs are respectively inserted into the two openings whereby the prongs expand within the openings to prevent the buckle from unintentionally disassociating.

8. The device of claim 1, wherein the second flange comprises a second flange length, and wherein the third flange comprises a third flange length.

9. The device of claim 8, wherein the second flange length is 2 inches or more.

10. The device of claim 8, wherein the second flange length is 4 inches or more.

11. The device of claim 8, wherein the third flange length is 2 inches or more.

12. The device of claim 8, wherein the third flange length is 4 inches or more.

13. The device of claim 8, wherein the first flange length is smaller than the second flange length.

* * * * *